United States Patent [19]

Siepmann

[11] Patent Number: 4,924,197

[45] Date of Patent: May 8, 1990

[54] ELECTROMAGNETIC RELAY

[75] Inventor: Richard Siepmann, Munich, Fed. Rep. of Germany

[73] Assignee: Siemens Aktiengesellschaft, Berlin and Munich, Fed. Rep. of Germany

[21] Appl. No.: 350,726

[22] Filed: May 12, 1989

[30] Foreign Application Priority Data

Jun. 30, 1988 [DE] Fed. Rep. of Germany ..... 8808401

[51] Int. Cl.[5] ..... H01H 67/02

[52] U.S. Cl. ..... 335/128; 335/78

[58] Field of Search ..... 335/78–85, 335/128, 133

[56] References Cited

U.S. PATENT DOCUMENTS 1,746,636 2/1930 Latlin et al. ..... 200/251

4,803,589 3/1989 Kimpel .

*Primary Examiner*—Leo P. Picard

*Assistant Examiner*—Lincoln Donovan

*Attorney, Agent, or Firm*—Hill, Van Santen, Steadman & Simpson

[57] ABSTRACT

In a relay, power lead elements of the load circuit are conducted between a core and a yoke in order to improve the response behavior of the relay as an auxiliary excitation. The power lead element is a stranded conductor having one end connected to the appertaining terminal element and the other end directly connected to the contact element. Therebetween, a stranded conductor is conducted from one side of the coil to the other through a transverse bore in a coil member flange. In this way, the stranded conductor and, thus, and the load circuit is well insulated from the winding and, moreover, the power lead element requires no space in the actual winding space, simplifying the assembly thereof as a result.

6 Claims, 1 Drawing Sheet

ELECTROMAGNETIC RELAY

BACKGROUND OF THE INVENTION

1. Field of the Invention

The present invention is directed generally to an electromagnetic relay having a coil which includes a winding applied to a coil member between end flanges thereof and having a core axially arranged within the winding. A yoke is included arranged outside of the winding and connected to one end of the core. An armature is seated at the yoke and forms a working air gap with the free end of the core. At least one switch contact is actuateable by the armature, the switch contact being connected through a power lead element to a terminal element, whereby the power lead element is conducted at least once through the excitation flux circuit formed by the yoke, core, and the armature.

2. Description of the Related Art

When switching electromagnetic load relays, a problem occurs in specific applications in that the excitation voltage for the winding drops off during the attraction of the armature. As a result, the armature is no longer fully attracted under certain circumstances which causes the armature to undergo a chattering motion. This causes the switch contact to either not close or to undergo repeated interruptions or openings before closing. This problem occurs particularly often in applications where the voltage source for the excitation winding of the relay also simultaneously supplies the current to the load, as is specifically the case in motor vehicles. When certain users or loads, such as lamps or starters, are switched on in a motor vehicle, extremely high turn-on current peaks appear which leads to the reduction of the battery voltage. Thus, reliable operation of the relay is no longer assured.

Another, related problem occurs when relays are driven by mechanical switches which have multiply longer bouncing times for the switch elements. As a result of these bouncing impacts, the relay is then also multiply switched on and off until it ultimately closes. Particularly when extremely high turn-on current peaks are required by the load, this leads to great stressing and/or erosion of the relay contacts. In extreme cases, for example, when switching lamp currents, it leads to welding of the contact members.

In a relay disclosed in European Published Application 0 231 793 and corresponding U.S. Pat. No. 4,803,589, it is provided to conduct the load current between the coil and yoke so that an auxiliary excitation is induced isodirectionally with the excitation of the winding. Given appropriate dimensioning, a reliable response of the relay is guaranteed in this way even when the excitation voltage drops off during the turn-on event or is interrupted in the interim as a consequence of a bouncing switch.

Given a relay of small volume, however, problems arise for guiding the load current around the excitation flux circuit under certain circumstances when there is only an extremely small gap present between the winding and the yoke, so that it is only possible to conduct a power lead element of large cross section therethrough with difficulty. It has thereby also been proposed to conduct a thin plate which occupies essentially the entire length of the winding between the winding and the yoke as the power lead element in order to obtain the required cross section for the load current and still provide an optimally low height. In any case, however, problems derive during assembly and problems derive in view of the insulation between the load circuit and winding in this type of relay.

SUMMARY OF THE INVENTION

It is an object of the present invention to improve the relay of the species initially cited so that an auxiliary excitation of the load circuit can be generated isodirectionally with the excitation circuit but so that a modification or interference in the actual winding space is simultaneously avoided and a reliable insulation of the power lead of the load circuit is guaranteed.

This and other objects of the invention are achieved in a relay wherein a power lead element has one side connected to the coil with a terminal element and is conducted to the other side of the coil through a transverse bore or opening in a coil flange and is then connected there to a switch contact.

The transverse opening in the coil member flange, of course, is situated in the region between the coil core and the yoke so that the desired auxiliary excitation for the relay is generated as the result of current flow through the power lead without having to mount an additional element in the actual winding space. Of course, the direction of the current flow through the power lead must be such that it has an additive effect on the magnetic flux. By guiding the current in the coil flange, it also guarantees a good insulation between the load circuit and the actual excitation circuit.

An auxiliary excitation that is generated by the power lead element conducted through the flange holds the relay in its attracted condition once the contact current has been switched on, so that even a brief interruption of the current due to the aforementioned bouncing during turn-on no longer allows the relay to drop off. Moreover, the auxiliary excitation upon turn-on promotes a rapid attraction of the relay armature, so that high contact forces are quickly achieved and any burning off or erosion of the contact material is kept within limits. After the decay of the initial current in the load circuit, for example after the filament of a lamp switch has been heated, the holding effect due to the auxiliary excitation is so slight that a disadvantageous influence on the relay during drop-off hardly occurs. The height of the auxiliary excitation can be defined on the basis of appropriate dimensioning or sizing of the elements. As needed, it is also possible to divide the power supply and to conduct only one part thereof through the transverse in the yoke.

The described auxiliary excitation is especially useful in relays wherein the armature and the yoke are traversed by the contact current. To thereby make the auxiliary excitation optimally high, the resistance through the armature and the yoke can thereby also be increased in that, for example, the contact spring is not manufactured of highly conductive material but of a poorly conductive spring material such as, for example, steel. This has an additional advantage than materials having better spring properties and higher fatigue strength for an infinite length of time can be used. These steel materials are also usually more cost beneficial than the highly conductive copper alloys that are otherwise required. The contact current is thereby expediently conducted through a stranded conductor directly welded onto the rivet head of the contact, the stranded conductor passing through the transverse bore in the coil flange.

DESCRIPTION OF THE PREFERRED EMBODIMENTS

Figure 1:
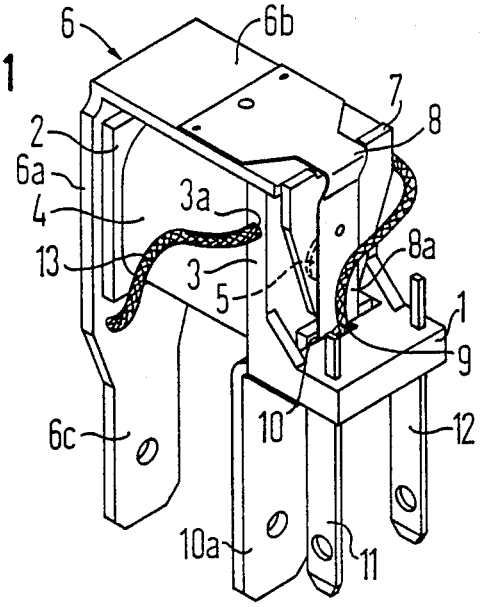
FIG. 1 is a perspective view of a relay according to the principals of the present invention.
Figure 2:
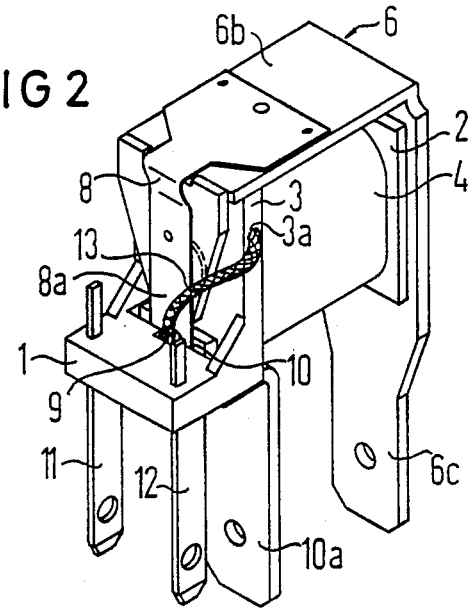
FIG. 2 is a second perspective view of the inventive relay of FIG. 1.

The relay shown in FIGS. 1 and 2 has an inherently known basic structure comprising a coil member 1 as a bearing element on which the winding 4 is applied between two flanges 2 and 3. A core 5 is axially attached inside the coil 1. The core 5 has one end connected to an angular yoke 6, namely connected to the leg 6*a* thereof which extends vertically, whereas the horizontal leg 6*b* extends above the coil 1. A flat armature 7 that is secured to the yoke 6 via an armature spring 8 is seated at a free end of the yoke leg 6*b*. An extension of the armature spring 8 serves as the contact spring 8*a* and carries the contact piece 9 at its free end which lies opposite a stationary cooperating contact piece 10. The cooperating contact piece 10 is secured to a terminal element 10*a* that is fashioned as a flat plug. A flat plug 6*c* fashioned as an extension of the yoke leg 6*a* serves as a terminal element for the contact piece 9 at the contact spring 8*a*.

Plug elements 11 and 12 are also anchored in a base body as coil terminal elements.

As a result of the described structure, thus, the current supplied to the contact 9 ensues via the yoke 6 and the armature 7. In order, however, to offer low resistance for high currents, a stranded conductor 13 is also provided, which is directly connected to the flat plug 6*c* at one end and has its other end directly welded on the contact piece 9. This copper stranded conductor 13 can, for example, carry up to 90 percent of the current, particularly when the armature spring 8, for instance, is manufactured of a relatively poorly conductive metal such as spring steel.

To also be able to generate an auxiliary excitation by the contact current in order to improve the attraction behavior of the relay, the stranded conductor 13 is conducted through a transverse bore 3*a* in the coil member flange 3. This transverse bore proceeds in a horizontal direction given the normal integration position of the relay, namely between the coil core 5 and the yoke legs 6*b*. To obtain the initially described promotion of the attractive behavior of the relay by the auxiliary excitation, the polarity when connecting the load circuit must be correspondingly selected so that the auxiliary excitation is added to the coil excitation.

Although other modifications and changes may be suggested by those skilled in the art, it is the intention of the inventor to embody within the patent warranted hereon all changes and modifications as reasonably and properly come within the scope of his contribution to the art.

I claim:

1. An electromagnetic relay, comprising:

a coil having a coil member with end flanges and a winding on said coil member between said end flanges;

a core arranged axially inside said winding, said core having a first end and a second free end;

a yoke arranged outside of said winding and being connected to said first end of said core;

an armature seated at said yoke and forming a working air gap with said second free end of said core;

a switch contact mounted for actuation by said armature; a terminal element;

a power lead element connected to said terminal element at one side of said coil;

one of said end flanges of said coil member having a transverse opening; and said power lead element passing through said transverse opening in said one end flange and being connected to said switch contact after said power lead element passes through said transverse opening relative to said terminal element.

2. An electromagnetic relay as claimed in claim 1, wherein said power lead element is a stranded conductor that directly connects said terminal element to said switch contact, and further comprising:

an armature spring mounted to bias said armature;

said switch contact being secured to said armature spring.

3. An electromagnetic relay as claimed in claim 1, wherein said transverse opening in said one end flange lies between said core and said yoke.

4. An electromagnetic relay as claimed in claim 1, wherein said yoke has a first leg lying perpendicular to a base plane of said relay, said yoke having a second leg lying parallel to said base plane above said coil; and said transverse opening in said one end flange lying under said second leg of said yoke and parallel to said base plane.

5. An improved electromagnetic relay having a coil member with an end flange and a winding about said coil member, a core lying within said winding and attached at one end to a yoke, said yoke extending outside said winding, an armature seated on said yoke and forming a working air gap with an end of said core, a switch contact actuable by said armature and a terminal element connected to said switch contact by a power lead element, the improvement comprising:

a transverse opening in said end flange, and said power lead element extending through said transverse opening in said end flange to conduct current through said transverse opening between said switch contact and said terminal element in a direction to add magnetic flux to flux generated by said winding.

6. An electromagnetic relay, comprising:

a magnetic flux circuit including:

a core having first and second ends, a winding about said core, a yoke connected to said first end of said core and lying outside of said winding, an armature movably mounted opposite said second end of said core to form a working air gap, said armature being magnetically coupled to said yoke so that magnetic flux flows through said flux circuit when current is passed through said winding;

a coil member having an axial opening within which said core lies, said coil member having coil flanges between which said winding is mounted;

load switching elements including:

a movable switch contact actuateable by said armature, a stationary switch contact against which said movable switch contact is moved by said armature, a power lead connected at a first end to said movable switch contact, and a terminal element connected to a second end of said power lead;

an opening in one of said coil flanges through which said power lead passes so that load current through said power lead causes an increase in said magnetic flux through said flux circuit.

* * * * *